US006422296B1

(12) United States Patent
Pöhlandt et al.

(10) Patent No.: US 6,422,296 B1
(45) Date of Patent: Jul. 23, 2002

(54) APPARATUS FOR MAKING READY-TO-POUR SHELLS OR CORE ASSEMBLIES

(75) Inventors: Werner Pöhlandt; Mohammed Ali Seiraffi, both of Schwetzingen (DE)

(73) Assignee: Hottinger Maschinenbau GmbH, Mannheim (DE)

( * ) Notice: Subject to any disclaimer, the term of this patent is extended or adjusted under 35 U.S.C. 154(b) by 0 days.

(21) Appl. No.: 09/297,629

(22) PCT Filed: Sep. 1, 1997

(86) PCT No.: PCT/DE97/01911

§ 371 (c)(1),
(2), (4) Date: May 4, 1999

(87) PCT Pub. No.: WO98/19810

PCT Pub. Date: May 14, 1998

(30) Foreign Application Priority Data

Nov. 4, 1996 (DE) ..... 96 45 448
Jun. 16, 1997 (DE) ..... 97 25 379

(51) Int. Cl.[7] ..... B22C 15/24
(52) U.S. Cl. ..... 164/200
(58) Field of Search ..... 164/200, 201, 164/202, 20, 21, 154.1, 155.1, 456

(56) References Cited

U.S. PATENT DOCUMENTS 4,100,961 A * 7/1978 Goss et al. ..... 164/180
4,757,855 A * 7/1988 Nagarwalla et al. ..... 164/19
5,014,766 A * 5/1991 Weber ..... 164/154
5,291,936 A * 3/1994 Rommel et al. ..... 164/22
5,544,694 A * 8/1996 Landua et al. ..... 164/20
5,697,424 A * 12/1997 Ferdinandsen et al. ..... 164/456
5,711,361 A * 1/1998 Landua et al. ..... 164/21
5,996,681 A * 12/1999 Pohlandt ..... 164/456
6,173,757 B1 * 1/2001 Pohlandt ..... 164/456

FOREIGN PATENT DOCUMENTS

| | | | |
|---|---|---|---|
| DE | 31 48 461 | 4/1983 | |
| DE | 43 18 259 | 2/1994 | |
| DE | 40 33 887 C2 * | 7/1994 | ..... B22C/13/12 |
| DE | 43 41 122 | 12/1994 | |
| DE | 195 34 984 | 8/1996 | |
| WO | WO-94/27762 A1 * | 12/1994 | ..... B22C/25/00 |

* cited by examiner

*Primary Examiner*—M. Alexandra Elve
*Assistant Examiner*—Kevin P. Kerns
(74) *Attorney, Agent, or Firm*—Alston & Bird LLP

(57) ABSTRACT

An apparatus for making ready-to-pour shells or core assemblies having a number of core shooting machines (1) corresponding to the number of different cores needed for completing a core assembly, and an assembly line (2), wherein the produced and solidified cores are removed from the core shooting machines (1), processed, if need be, and completed to the core assembly on the assembly line (2). In addition, for increasing production capacity at the least possible cost at least one additional core shooting machine (5) is provided which is configured for making as substitutes each of the cores needed for completing the core assembly.

15 Claims, 3 Drawing Sheets

APPARATUS FOR MAKING READY-TO-POUR SHELLS OR CORE ASSEMBLIES

BACKGROUND OF THE INVENTION

The invention relates to an apparatus and a method for making ready-to-pour shells or core assemblies with a number core shooting machines corresponding to the number of different cores needed for completing a core assembly and an assembly line, wherein the produced and solidified cores are removed from the core shooting machines and completed on the assembly line to the core assembly.

Basically, the present invention relates to the field of foundry practice. To produce castings of any kind, foundry cores or foundry molds are generally made as separate parts, combined, and joined together to form a casting mold or core assembly. Thereafter, these core assemblies are filled with molten metal for producing, for example, a metallic workpiece. In mass production, these core assemblies that are to be filled with molten metal, pass one after the other through the production line.

Within the scope of conventional production, the core shooting machines producing the required cores are linearly arranged in one line. The produced cores that are removed from the core shooting machine and processed, if need be, are deposited one after the other on an assembly line that rigidly couples the core shooting machines. Finally, the core assembly is completed from core shooting machine to core shooting machine, namely in the strictly predetermined sequence of their arrangement, which must exactly correspond to the sequence in the assembly of the cores.

In such a rigid, conventional production, the downtimes of an individual core shooting machine present a quite significant problem. Such downtimes result from repairs or maintenance. Thus, if one of the core shooting machines is down, the entire assembly line will have to be stopped, since each individual core or type of core is needed for completing the core assembly. If one wanted to continue in such a situation the operation of the assembly line and, thus, the assembly of cores, each core shooting machine would have to be provided with an adequately large inventory of cores to be entered as substitutes into the assembly process. However, such an inventory would be extremely space-intensive and problematic with respect to a safe storage of the cores, inasmuch as cores made of molding sand are highly sensitive parts, whose handling and storage is again problematic. Finally, in practice shells or core assemblies of the kind under discussion are produced by the core shooting machines without an additional inventory of cores, whereby high downtimes on individual core shooting machines cause quite considerable total downtimes of the production plant as a whole.

For example, assuming an annual requirement of 400,000 core assemblies, 48 work weeks per year, and three shifts per day, taking as a basis the linear arrangement of a total of eight core shooting machines with a cycle time per machine of 45 seconds, and 85% guaranteed availability of each machine, and further assuming that necessitated by maintenance (cleaning, repair, and service), a total of six work days per week and 23 work hours per day are available, i.e., a total of 48 weeks×6 days×23 hours=6,624 hours per year, an average total downtime will result in an amount of 7.23 hours per day and 50.7 hours per week. The downtime will then amount to 2.95 hours per day, or 20.7 hours per week with a maintenance duration of 4.28 hours per day and 30 hours per week.

Lastly, with a rigid linear coupling of the core shooting machine without additional core inventory, the conventional production leads to quite considerable downtimes and maintenance times of the entire production plant. Added to this is the further problematic situation that in the case of a downtime of a production plant comprising, for example, eight core shooting machines, several maintenance crews will be needed for simultaneously maintaining all core shooting machines. Had one maintained or repaired or serviced one core shooting machine after the other by a single maintenance crew, the total downtime would increase quite considerably. However, the employment of several maintenance crews is extremely costly with respect to personnel, and increases production costs quite significantly.

With respect to a relevant prior art, reference is made, only by way of example, to DE 31 48 461 C1 that discloses a core and shell shooting machine of the described type. Furthermore, U.S. Pat. No. 5,996,681 discloses an arrangement of the described kind for making ready-to-pour shells and core assemblies. In this arrangement, the core shooting machines producing the required cores as described above are linearly arranged along an assembly line. While the assembly line interconnects the core shooting machines in functional respect, one will have to expect quite considerable total downtimes for lack of individual core inventories at the respective core shooting machines.

It is therefore an object of the present invention to improve and further develop both an apparatus and a method for making ready-to-pour shells or core assemblies of the initially described kind in such a manner that in comparison with conventional production, it is possible to increase production capacity with the least possible expenditure.

SUMMARY OF THE INVENTION

The above and other objects and advantages of the invention are achieved by the provision of an apparatus which comprises a plurality of core shooting machines disposed along a production line, with the number of core shooting machines corresponding to the number of cores required to form a desired core assembly. An assembly line is positioned adjacent the production line so that the produced cores removed from the core shooting machines may be assembled into the desired core assembly, and at least one additional core shooting machine is positioned along or adjacent the assembly line, with the one additional core shooting machine being configured for the selective production of each of the cores required to form the desired core assembly.

In accordance with the invention, one departs from the conventional concept to the extent that no core inventories are provided for bridging downtimes. Instead, in accordance with the invention, the additional core shooting machine, hereafter also referred to as the standby machine, is provided, which can assume as a substitute the operation of each regular core shooting machine and, thus, serves to produce each of the cores required for completing the assembly. Lastly, each core that is produced as a substitute is supplied to the assembly process at the right time and at the right place.

In a particularly advantageous manner, the standby machine is stationarily arranged and thus is not moved as needed to the vicinity of the respectively shut down core shooting machine. Instead, the core produced by the standby machine is supplied to the assembly process at the right time and at the right place. To this end, it would be possible to associate the standby machine directly to the assembly line, for example, arrange it along the assembly line to precede or follow the regular core shooting machines.

Likewise, it would be possible to arrange the standby machine at a second assembly line, an additional line, that communicates with the first assembly line to the extent that a core produced by the standby machine is deposited on the additional line and transported via this additional line, which may extend, for example, parallel to the actual assembly line, to the region of the inoperative core shooting machine. A takeover by the active manipulators for subsequently completing the core assembly can be realized without difficulties.

As previously described, the assembly line could be linearly arranged at least in the broadest sense. In this instance, the additional line could extend substantially parallel to the assembly line, so that the core produced as a substitute by the standby machine can be transported exactly to where it is also actually needed due to a failure of a core shooting machine. By way of a kind of cross assembly, completion of the core assembly could then proceed from the other side of the assembly line.

Furthermore, it will be of advantage, to equip the standby machine by means of a robot or manipulator and/or by means of a conveying device with tools for optionally producing each of the cores needed for the desired core assembly. To this extent, it would be possible to produce with the standby machine any desired core with the therefor required tool. The tools could be removed from one or more tool inventories of the core shooting machines. However, it would likewise be possible to provide a tool inventory with substitute tools especially for the standby machine. Likewise, these tools would undergo a maintenance or cleaning process in the usual manner.

The assembly line interconnecting the core shooting machines and including, if need be, the standby machine in the production process could be arranged and designed in such a manner that cores deposited or assembled thereon pass the region of the core shooting machines at least twice. This would ensure that the standby machine can be arranged at any desired point along or adjacent the assembly line. The at least two-time passage along the core shooting machines makes it possible to transport the core produced as a substitute to the right place for assembly.

Quite specifically, the assembly line could form an open or closed transportation loop passing along the core shooting machines.

Within the scope of such a configuration, the transportation loop could be formed by two, approximately parallel extending, interconnected conveying tracks. These conveying tracks could again be linearly arranged. The conveying tracks may largely extend at the same level, so that the core shooting machines associated to the conveying tracks are all arranged likewise at the same level.

As a specific example, the core shooting machines could be arranged on both sides of the two conveying tracks, preferably symmetrically thereto. In this connection, it would be possible to arrange the core shooting machines, for example, in groups of two each. In any event, the core shooting machines can be associated in pairs. In this connection, the core shooting machines may comprise a double production feature. In this respect, a single tool would produce respectively two cores. These cores may again be two identical cores or two different cores, as will be described further below.

As regards an unimpeded access to the core shooting machines, it would be possible to arrange same, primarily, however, the standby machine, outside the transportation loop. Likewise however, it is also possible to arrange at least the standby machine, if need be, even one or more of the other core shooting machine within the loop. Such an arrangement could be of advantage, if it permits reducing the distances between the core shooting machines, so that the standby machine can easily serve all core shooting machines or there located depositing stations.

In functional respect, it will be of advantage to arrange the standby machine at the assembly line approximately in the center thereof. In this connection, however, the functional center is addressed and not the geographic center. Finally, the standby machine may be arranged in an advantageous manner such that it is possible to move from its position the cores of all core shooting machines to the respective depositing stations, if possible with one and the same manipulator.

To this extent, it will be of quite special advantage, when the cores produced by and removed from the standby machine can be deposited by means of the manipulator in desired locations of the transportation loop on the assembly line, or on pallets. To this end, it is possible to predetermine special depositing stations or to define them in their position. The depositing stations for the standby machine may correspond to the depositing stations of the individual core shooting machines. However, in an advantageous manner the depositing stations of the standby machine are close together, so that they can be reached, from the standby machine, with a single manipulator.

The manipulator may deposit directly onto the assembly line or onto pallets associated to the assembly line. Likewise, in a very advantageous manner, it is possible that the manipulator is also capable of depositing cores across the assembly line onto the opposite part of the assembly line, namely onto the respectively opposite conveying track. In this connection, the deposit will again be made onto pallets or within the scope of the assembly operation, onto previously deposited cores.

With respect to a least possible floor space requirement for the assembly line or for the entire arrangement of the core shooting machines, it will be of quite special advantage, when the cores can be deposited on the assembly line or pallet before or after a core shooting machine or a group of core shooting machines, when viewed in the direction of transportation of the assembly line. To this extent, one depositing station each serves to receive two different cores for two core shooting machines that produce these different cores. If a core machine has a double production feature, namely is capable of producing two different cores, it will be possible to combine respectively two core shooting machines with double production features to one group. Likewise to this extent, the depositing station serves to receive two different cores, namely likewise in this instance for two separate core shooting machines, with just only one depositing station being needed for this group of two core shooting machines.

Likewise, it is possible that the assembly line extends approximately in meander form and passes in this instance the region of the core shooting machines at least twice. In any event, it is to be ensured in principle that the region of the core shooting machines is passed at least twice, so that it is possible to arrange the standby machine as desired and to move thereafter the core produced by the standby machine to the region of the respectively shut down core shooting machine.

In a further advantageous manner, the assembly line mounts pallets serving to receive or assemble the cores. These pallets may be made in two parts, i.e., they may comprise a region for the actual assembly of the cores, an assembly space, and a region for depositing a core, a depositing space. In this instance, the depositing space serves to receive any core and to supply thereafter the deposited core to the assembly process, respectively in the correct sequence. Quite specifically, it would be possible to subdivide the pallet into the two previously mentioned regions, and these two regions of the pallet could be handled separately from each other or be joined together.

Until now, there has been mention of only one group of core shooting machines that are coupled via the assembly line. However, it is likewise possible to line up at least two groups of core shooting machines via corresponding assembly lines. To this extent, the core shooting machines required as a whole would be combined to groups. A core assembly completed in the first group of core shooting machines could be transferred to a following assembly line, whence further completion or assembly proceeds. Thus, it would be possible to insert, for example, any parts in the region between the assembly lines. Transfer stations with manipulators serving to transfer or conveying tracks may be provided in the region between or at the assembly lines.

Within the scope of a particularly suitable arrangement of the standby machine, same could be arranged directly at or near the transfer station and be associated to the group of respectively preceding or respectively following core shooting machines or even to both groups. Finally, one could produce with this standby machine any desired core from the preceding and from the subsequent group, after a corresponding tool change, so that this standby machine can be used quasi as a "jumper" for both groups of core shooting machines.

Quite specifically, and within the scope of a particularly favorable utilization of the entire production plant, it would be possible to convert, when viewed in the sequence of assembly, respectively the last core shooting machine of a respectively preceding group of core shooting machines to a standby machine for producing a core of any other core shooting machine, and to use same for producing the cores of the core shooting machines of the following group. Naturally, this last core shooting machine of the respectively preceding group could also serve to produce any desired core of any other core shooting machine of the same group of core shooting machines.

Within the scope of an alternative configuration, it would also be possible to convert, when viewed in the sequence of assembly, respectively the first core shooting machine of a respectively following group of core shooting machines to a standby machine for producing a core of any other core shooting machine, and to use same for producing cores of the core shooting machine of the respectively preceding group. Likewise, this core shooting machine serving as a standby machine could be easily used for producing cores of core shooting machines of the same group.

Likewise, when an additional core shooting machine, or standby machine, is provided according to the invention, the core shooting machines could be designed and constructed such that, within each group of core shooting machines, each of the core shooting machines is convertible to, and accordingly usable as a regular core shooting machine or a standby machine for producing a core of any other core shooting machine. Finally, this would provide an optimal variability of the entire production plant. Each regular core shooting machine of the there selected rigid arrangement could serve both as a regular core shooting machine and as a standby machine and be thus used as a "jumper", with all core shooting machines being stationarily arranged. The jumper function thus results not from a movable arrangement of the core shooting machines, but rather from a variable association of the tools, whereby each of the core shooting machines can lastly handle the production of each concrete core.

Furthermore, when viewed in the functional respect, it is possible to provide between the groups of core shooting machines, i.e., between the assembly lines, storage spaces for entering or removing individual cores and/or previously completed or at least partially completed core assemblies. These storage spaces, between the groups of core shooting machines or between the assembly lines, could serve as safety buffers or for processing or using the cores or core assemblies elsewhere.

Furthermore, a deburring device could follow each core shooting machine after the removal station in the region preceding the assembly line, i.e., between the removal station and the assembly line. After passing through such a deburring device, it would be possible to provide a further station for the quality control, so that an assembly with defective cores is effectively avoided. In the case of detecting a defective core, it would be possible to shut down for maintenance purposes the core shooting machine that produced the defective core. The core required for continuity of the assembly process could be produced, as described above, by the standby machine and be supplied to the assembly process.

Further, it would be possible to associate, preferably to each core shooting machine, a robot or manipulator with at least one gripper, the robot serving to remove, further handle, and assemble or deposit the respectively produced cores.

As previously described, the core shooting machines and, thus, likewise the standby machine could be machines with double production features for the simultaneous production of two cores. It would likewise be possible to provide as a core shooting machine a double machine, namely a machine with two independently operating shooting heads. To this end, each core shooting machine also comprises two independent sand and compressed-air supplies. Two core shooting machines combined to a group and arranged side by side could thus serve to produce in pairs the same core types. In this connection, each of these core shooting machines could produce just two different core types.

Furthermore, it is possible to provide at the depositing stations of the standby machines cameras for monitoring the pallets or the assembly situation. In this respect, it would be possible to monitor the respective condition effectively and, regardless of the assembly situation, one could allow the pallets to circulate several times in the transportation loop until the assembly of the core is completed. To this extent, one could forego a tool change in the standby machine during the failure of a core shooting machine, and, as regards the missing core, one could have the incomplete core assembly circulate several times, until the completion is possible.

Finally, it is also possible to provide cameras for monitoring the pallets or assembly situation on the pallets not only at the depositing stations of the standby machine, but at also the depositing stations of all core shooting machines. In this respect, the monitoring would be continuous and concern all depositing stations, thereby monitoring the overall condition of the production plant for purposes of optimizing the production.

The method of the present invention for making ready-to-pour shells or core assemblies accomplishes the foregoing objects and includes the steps of making ready-to-pour shells or core assemblies, wherein cores of molding material are produced and solidified in at least two core shooting machines, removed from the core shooting machines, processed, if need be, and completed together to a core assembly. In the event of a failure or maintenance of one of the core shooting machines, each of the cores required for completing a core assembly can be produced as substitutes by the additional core shooting machine.

The following advantageous characteristics relating to the method of the present invention correspond to the above-described characteristic features of the apparatus according to the invention.

Thus, the standby machine or jumper may be operated stationarily, the cores produced by the standby machine being deposited or assembled on the assembly line or on pallets supported for movement on the assembly line. As an alternative, it is possible to deposit the cores produced by the standby machine on a further or additional assembly line or on pallets supported for movement on the additional line, the additional line communicating with the first assembly line.

Provided the assembly line is linearly arranged at least in the broadest sense, the additional line could extend substantially parallel to the assembly line.

For optionally producing each of the cores required for the assembly, the standby machine could be equipped with tools, preferably from a tool inventory by means of a robot or by means of a manipulator and/or a conveying device. Due to the arrangement of the assembly line, the cores deposited or assembled on the assembly line could pass the region of the respective core shooting machines at least twice, the cores being transported on the assembly line via an open or closed transportation loop that passes the core shooting machines. Likewise, it would be possible to transport the cores on the assembly line approximately in meander form and, in so doing, to have them pass the region of the core shooting machines at least twice.

To the extent that the pallets are subdivided into an assembly space and a depositing space, it would be possible to use and, if need be, handle the two parts of the pallets separately from each other.

Basically, at least two groups of core shooting machines are lined up via corresponding assembly lines, the cores or core assemblies being transferred from one the assembly line to the other assembly line by means of manipulators positioned at transfer stations. In the sequence of the assembly, respectively the last core shooting machine of each preceding group is converted to a standby machine for producing a core of any other core shooting machine, and used for producing cores of the core shooting machine of the following group.

It is likewise possible to convert, in the sequence of the assembly, respectively the first core shooting machine of each subsequent group to a standby machine for producing a core of any other core shooting machine, and to use it for producing cores of the core shooting machines of each preceding group. Finally, within each group of core shooting machines it is possible convert and use accordingly each of the core shooting machines as a regular core shooting machine or as standby machine for producing a core of any other core shooting machine. In functional respect, individual cores and/or previously assembled cores are entered into storage spaces and removed therefrom between the groups of core shooting machines, i.e., between the assembly lines.

After their removal, the cores may be deburred in the region preceding the assembly line. In so doing, after having been removed, preferably after having been deburred, the cores are checked for quality before the assembly line. Preferably, each core shooting machine is associated with a robot or manipulator with at least one gripper. In this instance, the robot removes, handles, assembles, or deposits the produced cores.

For a better illustration of the inventive concept and for rating the advantages and disadvantages in comparison with conventional production of the prior art, the following case of need is presented that corresponds to the initially described example:

Required core assemblies per year: 400,000

Number of weeks per year: 48

Number of shifts per day: 3

Conventional Concept

Serially arranged core shooting machines without buffer and rigidly coupled via an assembly lines.

Number of machines: 8

Cycle time per machine: 45 sec.

Guaranteed availability: 85%

Necessitated by maintenance (cleaning and repair):

Number of working days per week: 6

Number of working hours per day: 23 i.e., 48×6×23=6,624 hours per year

| | |
|---|---|
| Total shutdown time per day (average)[week]: | 7.23 hrs [50.7 hrs] |
| Downtime: 2.95 hrs [20.7 hrs] | 23 hrs × (1–0.85%) = 3.45 × 6 = 20.7/7 = 2.95 hrs |
| Maintenance time: 4.28 hrs [30 hrs]24 hrs + 6 (24 Hrs–23 hrs) = 30/7 | =4.28 hrs |

"7×24" Concept of the Invention

If one calculates 3.4 MC (core shooting machines), but must use 4 MC, or if one requires 8 MC, but uses 9 MC, one will be able to use these excess capacities either to produce 7 days for 24 hours per day, i.e., around the clock, or to increase availability. To this end, one must prepare a corresponding maintenance schedule and guarantee technical boundary conditions. Technical solutions include among others cross assembly, multiple tool changes, and the previously addressed dual purpose pallet.

In the case of serially arranged core shooting machines plus one standby machine (jumper) and with a tripartite assembly line and two core inventories, the situation in comparison with the conventional production is as follows:

Number of machines: 8+1

Cycle time per machine: 45 sec.

Guaranteed availability: 85%

Necessitated by maintenance (cleaning and repair):

Number of working days per week: 7

Number of working hours per day: 24 i.e., 48×7×24=8,064 hrs/year

Required production time per day (average)[week]: 14.9 hrs[104.34 hrs]

Effective production hours with conventional scheduling: 24 hrs–7.23 hrs=16.77 hrs per day and MC 16.77 hrs×8MC/9MC=14.9×7=104.34 hrs Total shutdown time per day (average)[week]: 9.1 hrs [63.7 hrs] 24–14.9=9.1×7=63.7 hrs Downtime: 2.63 hours [18.4 hrs] (14.9/85%)–14.9=2.63×7=18.4 hrs Maintenance time: 6.47 hrs [45.29 hrs] 9.1 hrs–2.63 hrs=6.47×7=45.29 hrs

| | Concept 2000: | Conventional: | Change |
|---|---|---|---|
| Machine investment | 9X.... | 8X.... | +12.50% |
| Working hours per year | 8,064 | 6,624 | +21.74% |
| Maximum number of core assemblies per year | 645,120 | 529,920 | +21.74% |
| Capacity reserve [based on 400,000] | 61.28% | 32.48% | +88.66% |

-continued

| | Concept 2000: | Conventional: | Change |
|---|---|---|---|
| Maintenance time per week | 45.29 hrs | 30 hrs | +50.96% |
| Maintenance per day | 6.47 hrs | 1 hr | +547% |

Added to this are the following advantages:

By dividing the assembly line, it is possible to produce partially completed core assemblies.

Assuming a total maintenance time of 6 hours per machine and week, one will need in the case of conventional scheduling six maintenance teams (two maintenance teams per shift), to perform within a day maintenance, cleaning, and repair. Since the maintenance team is fully occupied only on one day, it will be necessary to outsource a portion of these duties.

In the previously described "7×24" concept, however, only one team will be needed that can perform the maintenance work distributed over the week. This may be done by internally trained personnel. The maintenance schedule could be as follows:

Every 54 hours, the machine will be serviced for six hours.

| | Mon1 | Mon2 | Mon3 | Mon4 | Tue1 | Tue2 | Tue3 | Tue4 | Wed1 | Wed2 |
|---|---|---|---|---|---|---|---|---|---|---|
| MC1 | ■ | | | | | | | | | |
| MC2 | | ■ | | | | | | | | |
| MC3 | | | ■ | | | | | | | |
| MC4 | | | | ■ | | | | | | |
| MC5 | | | | | ■ | | | | | |
| MC6 | | | | | | ■ | | | | |
| MC7 | | | | | | | ■ | | | |
| MC8 | | | | | | | | ■ | | |
| MC9 | | | | | | | | | ■ | |
| MC1 | | | | | | | | | | ■ |

Every week, one maintenance is performed for six hours without night shift and weekend work.

| | Mon1 | Mon2 | ... | Tue1 | Tue2 | ... | Wed1 | Wed2 | ... | Thu1 | Thu2 | ... | Fri1 | ... | ... | Mon1 |
|---|---|---|---|---|---|---|---|---|---|---|---|---|---|---|---|---|
| MC1 | ■ | | | | | | | | | | | | | | | |
| MC2 | | ■ | | | | | | | | | | | | | | |
| MC3 | | | | ■ | | | | | | | | | | | | |
| MC4 | | | | | ■ | | | | | | | | | | | |
| MC5 | | | | | | | ■ | | | | | | | | | |
| MC6 | | | | | | | | ■ | | | | | | | | |
| MC7 | | | | | | | | | | ■ | | | | | | |
| MC8 | | | | | | | | | | | ■ | | | | | |
| MC9 | | | | | | | | | | | | | ■ | | | |
| MC1 | | | | | | | | | | | | | | | | ■ |

-

In other words: if one proceeds from 3×6 hours maintenance per machine and week, i.e. 18 hours per week, 63.7−18=45.7 hours will remain as reserve.

| | Mon 1 | Mon 2 | Mon 3 | Mon 4 | Tue 1 | Tue 2 | Tue 3 | Tue 4 | We 1 | We 2 | We 3 | We 4 | Thu 1 | Thu 2 | Thu 3 | Thu 4 | Fri 1 | Fri 2 | Fri 3 | Fri 4 | Sat 1 | Sat 2 | Sat 3 | Sat 4 | Sun 1 | Sun 2 | Sun 3 | Sun 4 |
|---|---|---|---|---|---|---|---|---|---|---|---|---|---|---|---|---|---|---|---|---|---|---|---|---|---|---|---|---|
| MC1 | ■ | | | | | | | | | ■ | | | | | | | | | ■ | | | | | | | | | X |
| MC2 | | ■ | | | | | | | | | ■ | | | | | | | | | ■ | | | | | | | | X |
| MC3 | | | ■ | | | | | | | | | ■ | | | | | | | | | ■ | | | | | | | X |
| MC4 | | | | ■ | | | | | | | | | ■ | | | | | | | | | ■ | | | | | | X |
| MC5 | | | | | ■ | | | | | | | | | ■ | | | | | | | | | ■ | | | | | X |
| MC6 | | | | | | ■ | | | | | | | | | ■ | | | | | | | | | ■ | | | | X |
| MC7 | | | | | | | ■ | | | | | | | | | ■ | | | | | | | | | ■ | | | X |
| MC8 | | | | | | | | ■ | | | | | | | | | ■ | | | | | | | | | ■ | | X |
| MC9 | | | | | | | | | ■ | | | | | | | | | ■ | | | | | | | | | ■ | X |

X: Reserve

With a reserve far greater than 168 hours/week−18 hours/week=150 hours/week, again greater than 45.7/150, downtimes of up to 30% (i.e. 70% availability) can be absorbed.

The following Tables A and B further illustrate the inventive concept

TABLE A

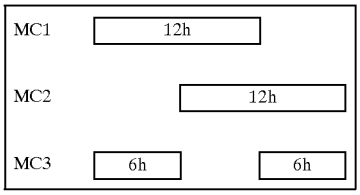

7 × 24 Concept
7 days per week

TABLE B

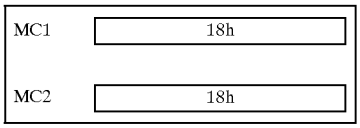

Conventional
6 days per week

Table B illustrates the conventional production with two core shooting machines, each machine running 18 hours per day in a parallel manner. The machines only run six days per week, with the seventh day being needed for service.

Table A illustrates the inventive concept with the machines each running 12 hours per day. In the first six hours, machines 1 and 3 are running, in the second six hours, machines 1 and 2 are running, and in the third six hours, machines 2 and 3 are running. Thus, during the first six hours, machine 2 can be cleaned and/or repaired. Within the second six hours, machine 3 can be cleaned and/or repaired, and within the third six hours, machine 1 can be cleaned and/or repaired.

BRIEF DESCRIPTION OF THE DRAWINGS

There exist various possibilities of improving and further developing the teaching of the present invention in an advantageous manner. To this end, reference may be made on the one hand to the claims and on the other hand to the following description of two embodiments of the invention with reference to the drawing in which:

DETAILED DESCRIPTION OF THE PREFERRED EMBODIMENTS

Figure 1:
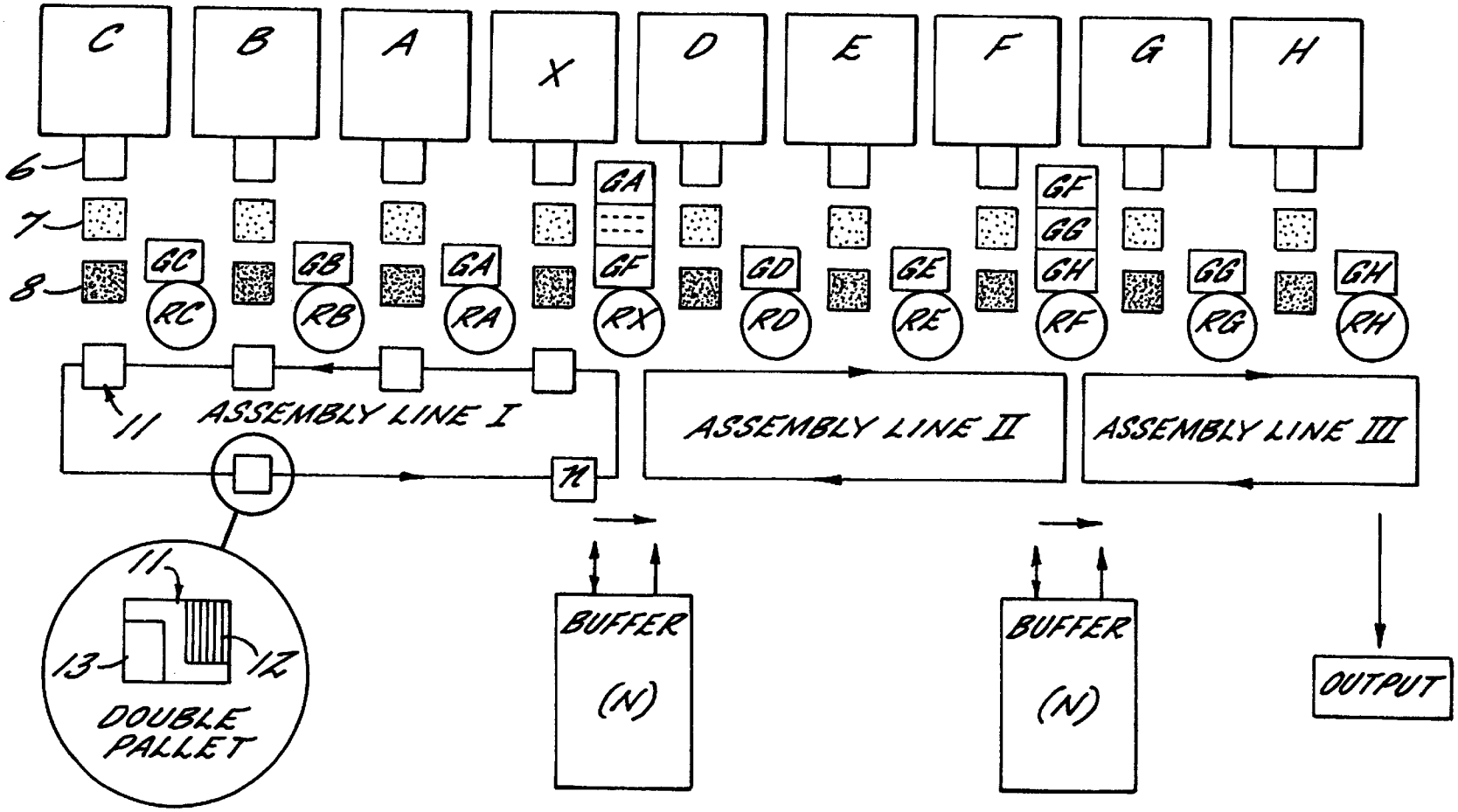
FIG. 1 is a schematic view of a first embodiment of an arrangement according to the invention for making ready-to-pour core assemblies, the arrangement comprising three assembly lines.
Figure 2:
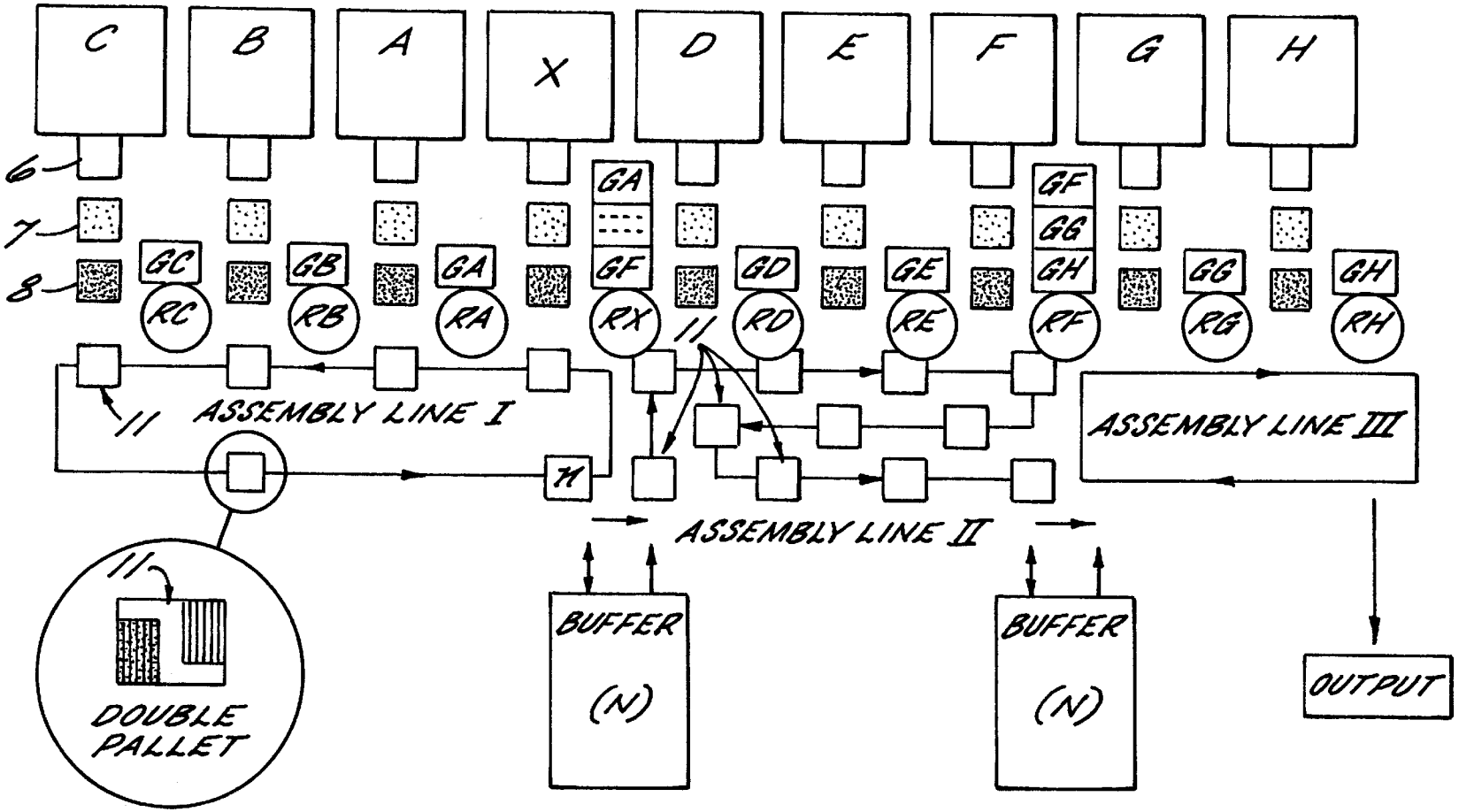
FIG. 2 is a schematic view of a second embodiment of an arrangement according to the invention for making ready-to-pour core assemblies, the arrangement comprising likewise three assembly lines, and the center assembly line extending approximately in meander form.

FIGS. 1 and 2 are schematic views of two embodiments of an apparatus according to the invention for making ready-to-pour shells or core assemblies. The arrangement includes a number of core shooting machines corresponding to the number of different cores necessary for completing a core assembly, the core shooting machines being individually identified by the characters A–H. Furthermore, three assembly lines I, II, III are provided.

In accordance with the invention, at least one additional or standby core shooting machine X is provided for making as a substitute each of the cores necessary for the core assembly.

The apparatus further comprises removal stations 6 associated with the core shooting machines, deburring devices 7 likewise associated with the core shooting machines, as well as well as correspondingly associated quality control stations 8. Furthermore, the cores shooting machines are associated with robots identified RA, RB, etc., and the robots have grippers, identified as GA, GB, etc.

According to the embodiment shown in FIG. 1, the assembly lines I, II, III each form closed transportation loops. The assembly lines comprise pallets 11 for receiving or assembling the cores, which are constructed as dual purpose pallets. More specifically, the pallets 11 each comprise an assembly space 12 for assembling the cores and a depositing space 13 serving to receive a separate core.

Furthermore, in the region between assembly lines, transfer stations (not shown) are arranged with manipulators or robots that are used for transferring the cores.

Furthermore, the Figures show that the assembly lines are associated at the transfer stations with material buffers in which substitute cores can be stored, and from which substitute cores can be removed for inclusion in the assembly process. The buffer capacity is indicated by N.

The sequence of operations of the arrangement schematically illustrated in FIG. 1 is shown in the following table, wherein the core shooting machines are abbreviated by the letters KSM.

| | | | Sequence of Operations | | | |
|---|---|---|---|---|---|---|
| Maintenance | KSM X | RX | KSM F | RF | Other | Remark |
| KSM A | KSM A | Pak. A | KSM F | Pak. F | RA > inoperative | 1 Tool Change |
| KSM B | KSM B | Abl. B | KSM F | Pak. F | RB > Pak. B | 1 Tool Change |
| KSM C | KSM C | Abl. C | KSM F | Pak. F | RC > Pak. C | 1 Tool Change |
| KSM D | KSM D | Pak. D | KSM F | Pak. F | RD > inoperative | 1 Tool Change |
| KSM E | KSM E | Abl. E | KSM F | Pak. F | RE > Pak. E | 1 Tool Change |
| KSM F | KSM F | Abl. F | — | — | RF > Pak. F | 1 Tool Change |

-continued

| Sequence of Operations | | | | | | |
|---|---|---|---|---|---|---|
| Maintenance | KSM X | RX | KSM F | RF | Other | Remark |
| KSM G | KSM F | Abl. F | KSM G | Abl. G | RF > Pak. F & RG > Pak. G | 2 Tool Changes |
| KSM H | KSM F | Abl. F | KSM H | Abl. H | RF > Pak. F & RG > Pak. H | 2 Tool Changes |

Abl. = Deposit
Pak. = Assemble

To describe the above table in more detail, the first vertical column lists the core shooting machines A–H. The second vertical column describes the core shooting machine X working as a jumper, and wherein the function can be switched to any of the machines. In the next vertical column, RX stands for a robot which manipulates the cores and the executed assembly is also indicated. KSM F is the core shooting machine producing a special core (F, G, H). RF is also a robot to handle the cores and to package the cores. The "Other" column describes special situations which are obtainable as described, and the "Remark" column describes the number of tool changes to be executed.

For example, if the core shooting machine A is serviced, the standby machine X will assume production of core A that is deposited by robot RX on the first assembly line and assembled thereon. The core shooting machine F produces a core that is accordingly assembled by robot RF. Robot RA is in this instance inoperative.

If core shooting machine B is now serviced, the core of machine B will be produced by standby machine X and deposited by robot RX on the first assembly line. Core shooting machine F continues to produce the core for machine F. In this process, robot RX is used only to deposit the core, and robot RB to stack the core on previously deposited core A.

If core machine C is serviced, standby machine X will produce the core of machine C that is deposited by robot RX on the first assembly line. Core shooting machine F continues to produce core F. In this process, robot RC is used to assemble core of machine C etc.

If core shooting machine F is now serviced, standby machine X will produce the core of machine F, with robot RX serving to deposit the core of machine F. Robot RF will then serve to assemble core of machine F etc.

In this process, it is important that the sequence be observed, since otherwise only a 50% output is achieved, namely a) Up to the number of KSM/2 tool changes;

b) Cross assembly: for example, RX will assemble at assembly space (n), should C be serviced; and c) Dual purpose pallet with depositing space for cores (see above)>only 2 tool changes at most.

The situation with the arrangement of FIG. 2 is similar, wherein the assembly line II extends as an open assembly loop approximately in meander form. Accordingly, the sequence of operations differs from that of the embodiment shown in FIG. 1, namely according to the following Table that speaks for itself, se that a further reaching discussion with respect to the exemplary description of the sequence of operations according to FIG. 1 is not needed.

| Sequence of Operations | | | | | | |
|---|---|---|---|---|---|---|
| Maintenance | KSM X | RX | KSM F | RF | Other | Remark |
| KSM A | KSM A | Pak. A | KSM F | Pak. F at 5 | — | 1 Tool Change |
| KSM B | KSM B | Abl. B | KSM F | Pak. F at 5 | RB > Pak. B | 1 Tool Change |
| KSM C | KSM C | Abl. B | KSM F | Pak. F at 5 | RC > Pak. C | 1 Tool Change |
| KSM D | KSM D | Pak. D at 2 | KSM F | Pak. F at 5 | — | 1 Tool Change |
| KSM E | KSM E | Pak. E at 8 | KSM F | Pak. F at 11 | — | 1 Tool Change |
| KSM F | KSM F | Pak. F at 8 | — | — | — | 1 Tool Change |
| KSM G | KSM F | Pak. F at 8 | KSM G | Pak. G | — | 2 Tool Changes |
| KSM H | KSM F | Pak. F at 8 | KSM H | Abl. H | RH > Pak. H | 2 Tool Changes |

Abl. = Deposit
Pak. = Assemble

1. The sequence is important.
2. The number of pallets n and buffer capacity N must be adapted to the data of the customer.
3. Jumper KSM X must be universal. This means a core shooting machine with loose part devices.

Further comments on the working sequences shown in the foregoing table are not needed, when referring to the general description on the one hand and the claims on the other hand, inasmuch as these working sequences result on the one hand from the constructional features and on the other hand from the steps relating to the method of the present invention.

Figure 3:
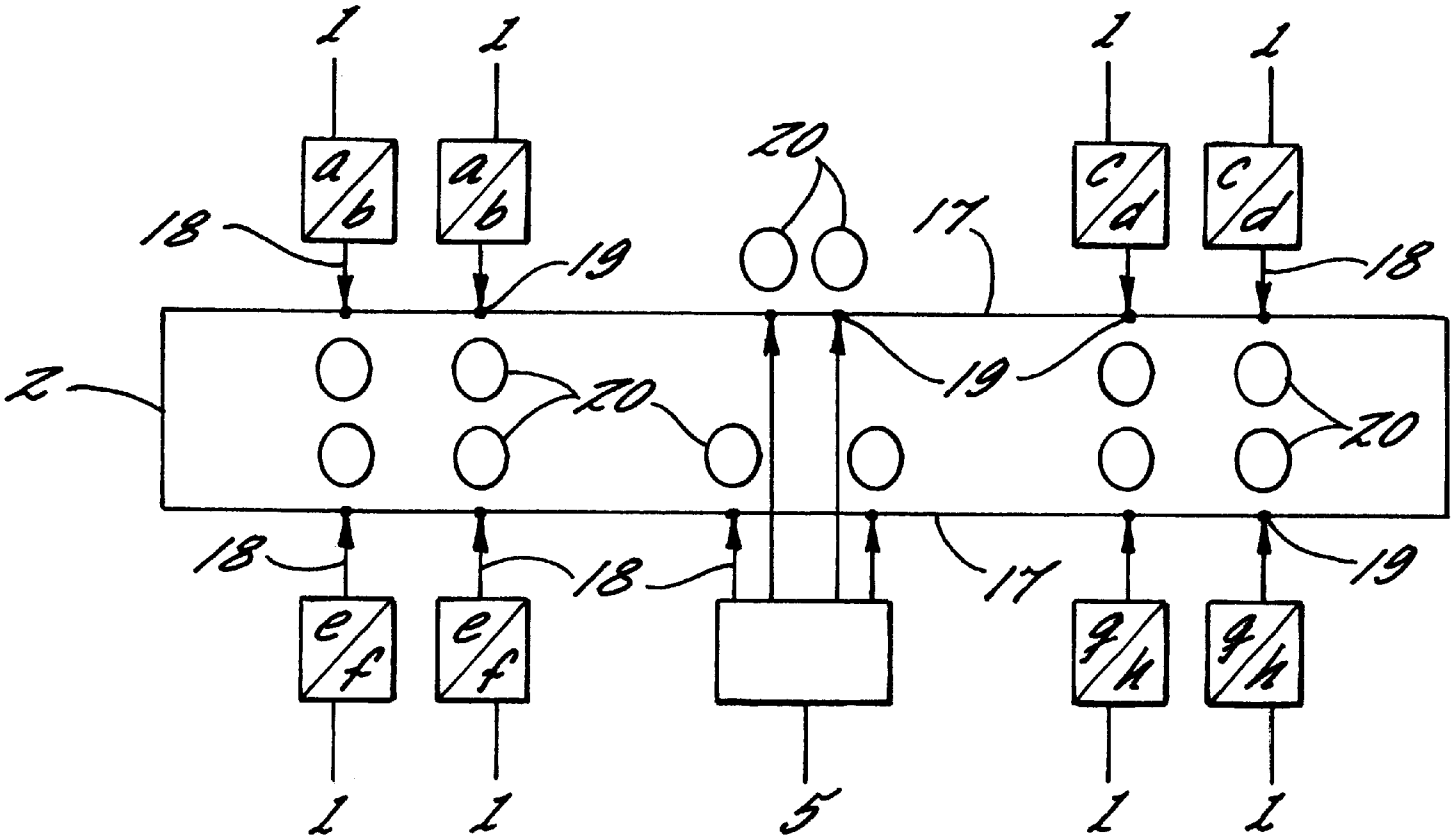
FIG. 3 is a schematic view of a third embodiment of an arrangement according to the invention for making ready-to-pour core assemblies, the arrangement comprising a single assembly line with a closed transportation loop and two opposite conveying tracks as well as a centrally arranged standby machine.

FIG. 3 shows a further embodiment of an arrangement according to the invention for making ready-to-pour shells or core assemblies. In this embodiment, the assembly line 2 is constructed in the sense of a closed transportation loop. This transportation loop is formed by two parallel extending, interconnected conveying tracks 17. The two conveying tracks 17 extend at the same level. This arrangement is however not relevant from the schematic illustration.

The core shooting machines 1 are arranged on both sides of the two conveying tracks 17, with the selected embodiment showing a symmetric arrangement.

As can further be noted from FIG. 3, the core shooting machines 1 are locally combined to groups of two core shooting machines 1 each. Both the core shooting machines 1 and the standby machine 5 are arranged outside of the conveying track. From the core shooting machines 1 and the standby machine 5, the cores are transported via a conveying device not shown or via manipulators 18 to the respective depositing stations 19.

In functional respect, the standby machine 5 is arranged at the assembly line approximately in the center thereof. As previously described, the cores removed from standby machine 5 are transported by manipulator 18 to predetermined depositing stations 19, namely deposited on pallets of assembly line 2, which are not shown in FIG. 3.

As is further shown in FIG. 3, the manipulator 18 can move cores both directly onto the assembly line 2 or onto pallets arranged thereon as well as across the assembly line 2 onto the opposite portion of assembly line 2 or opposite conveying track 17 and, thus, onto pallets arranged thereon. In any event, when viewed in the direction of transportation of assembly line 2, the cores can be deposited before or after a core shooting machine 1 or a group of core shooting machines 1 in the respective depositing station 19 on assembly line 2 or the pallets. In any event, it is essential for the embodiment of FIG. 3 that two core shooting machines each be combined to a group of core shooting machines. This makes it possible to impart to standby machine 5 an enormous radius of action, namely to deposit, without leaving its location, onto the assembly line 2 cores for a total of four groups of core shooting machines at two core shooting machines each. Finally, on the part of standby machine 5 cores are deposited four times in four depositing stations, thereby making available substitute cores for a total of eight core shooting machines and, thus, eight different cores as substitutes. As is further indicated in FIG. 3, the core shooting machines 1 combined to groups of two produce each two different cores, namely cores a/b, c/d, e/f, and g/h. To this end, each core shooting machine comprises two independently operating shooting heads with separate compressed-air and sand supplies. As regards such a double machine, reference is made to U.S. Pat. No. 5,291,936, which is herewith incorporated by reference. Finally, two juxtaposed core shooting machines 1 serve each to produce in pairs respectively identical core types according to the foregoing description.

Finally, FIG. 3 indicates that cameras 20 are provided both on the depositing stations 19 of standby machine 5 and on the depositing stations of core shooting machines 1 for monitoring the pallets or the assembly situation. To this extent, the general part of the specification is herewith incorporated by reference.

In conclusion, it should be explicitly pointed out that the above-described embodiments serve only to explain the claimed teaching without, however, limiting it to the embodiments.

What is claimed is:

1. Apparatus for producing individual cores to be used in the fabrication of multi-part core assemblies which serve as foundry molds, and comprising a plurality of core shooting machines disposed along a production line, with the number of the core shooting machines corresponding to the number of cores required to form a desired core assembly, an assembly line positioned adjacent the production line so that the produced cores removed from the core shooting machines may be assembled into the desired core assembly, at least one additional core shooting machine positioned along or adjacent the assembly line, with the one additional core shooting machine being configured for the selective production of each of the cores required to form the desired core assembly, a manipulator associated with each core shooting machine for transferring the produced cores to the assembly line, and wherein the assembly line includes a first track that extends along the production line and a second track that communicates with and lies substantially parallel to the first track, and wherein the manipulators are configured to selectively deposit the produced cores on either the first track or the second track of the assembly line.

2. The apparatus as defined in claim 1 wherein the one additional core shooting machine is at a fixed location along or adjacent the assembly line.

3. The apparatus as defined in claim 2 wherein the one additional core shooting machine is located at one end of the production line.

4. The apparatus as defined in claim 1 wherein the core shooting machines are disposed along both sides of the first and second tracks of the assembly line.

5. The apparatus as defined in claim 4 wherein the core shooting machines are combined in groups of two closely adjacent core shooting machines.

6. The apparatus as defined in claim 1 wherein the assembly line further includes a third track that communicates with and lies substantially parallel to the second track, and wherein the manipulators are configured to selectively deposit the produced cores on any one of the first, second, and third tracks of the assembly line.

7. The apparatus as defined in claim 1 wherein the one additional core shooting machine is located at a medial location along the length of the assembly line.

8. The apparatus as defined in claim 1 wherein the apparatus further comprises a plurality of pallets mounted for movement along the assembly line for receiving and supporting the produced cores.

9. The apparatus as defined in claim 8 wherein the pallets are each divided into two regions comprising a core depositing region and a core assembly region.

10. The apparatus as defined in claim 1 wherein the core shooting machines are arranged in a plurality of adjacent groups, with a separate assembly line positioned adjacent each group, and further comprising a manipulator for transferring cores from each assembly line to the next assembly line or to an output.

11. The apparatus as defined in claim 10 wherein at least one core shooting machine of each group is configured for selectively producing cores produced by one or more of the other core shooting machines of the apparatus.

12. The apparatus as defined in claim 10 wherein the apparatus further comprises a storage space located between adjacent assembly lines for receiving and storing individual cores or partially assembled cores.

13. The apparatus as defined in claim 1 wherein the apparatus further comprises a core deburring device associated with each of the core shooting machines.

14. The apparatus as defined in claim 13 wherein the apparatus further comprises a quality control station associated with each of the core shooting machines.

15. The apparatus as defined in claim 1 wherein the core shooting machines are each equipped with two shooting heads which operate independently from each other.

* * * * *